US007178977B2

(12) United States Patent
Colding-Kristensen et al.

(10) Patent No.: US 7,178,977 B2
(45) Date of Patent: Feb. 20, 2007

(54) HOMOGENIZER

(75) Inventors: Holger Colding-Kristensen, Hals (DK); Hans Henrik Mortensen, Noerresundby (DK)

(73) Assignee: Scanima A/S, Aalborg (DK)

( * ) Notice: Subject to any disclaimer, the term of this patent is extended or adjusted under 35 U.S.C. 154(b) by 491 days.

(21) Appl. No.: 10/480,725

(22) PCT Filed: Jun. 21, 2002

(86) PCT No.: PCT/DK02/00392

§ 371 (c)(1),
(2), (4) Date: Dec. 12, 2003

(87) PCT Pub. No.: WO03/002241

PCT Pub. Date: Jan. 9, 2003

(65) Prior Publication Data

US 2004/0190373 A1 Sep. 30, 2004

(30) Foreign Application Priority Data

Jun. 12, 2001 (DK) ..... 2001 00917

(51) Int. Cl.
*B01F 5/16* (2006.01)
*B01F 7/20* (2006.01)

(52) U.S. Cl. ..... 366/264; 366/314; 366/306; 366/266

(58) Field of Classification Search ..... 366/264, 366/164.1, 306, 314, 262, 266
See application file for complete search history.

(56) References Cited

U.S. PATENT DOCUMENTS 4,002,326 A 1/1977 Brogli et al.
4,506,991 A 3/1985 Hudson
6,000,840 A 12/1999 Paterson

FOREIGN PATENT DOCUMENTS

| | | | |
|---|---|---|---|
| DK | 128597 B | * | 6/1974 |
| EP | 024294 | | 9/1990 |
| GB | 1100782 | | 1/1968 |
| GB | 1203459 | | 8/1970 |
| GB | 2120566 | | 12/1983 |
| WO | WO 0074829 | | 12/2000 |

* cited by examiner

*Primary Examiner*—Terry K. Cecil
(74) *Attorney, Agent, or Firm*—Kolisch Hartwell, P.C.

(57) ABSTRACT

In a homogenizer for the processing of products to be homogenized, in particular foodstuffs incorporating dairy products, where the homogenizer is of the mixer type with a blade wheel(8) in a mixer tank (1) and a tubular perforated skirt (3) located radially closely outside the blades (10) of the blade wheel (8), that the skirt stationary relative to the rotor on the hub (6) is arranged axially displaceable also during the rotation of the blades (10) for displacement from a position in which a perforated skirt section (3.2) having a set of flow perforations or orifices (4) is located radially opposite the blades (10) of the rotor, to at least one other position in which another perforated skirt section (3.1 or 3.2) having another set of flow perforations or orifices in the form of perforations or orifices and/or slots (4) or at the most a part of a perforated skirt section is located radially opposite the blades (10), is achieved a homogenizer which is more simple to use than the known apparatus and which may serve more functions for homogenization of foodstuffs without transferring the foodstuff product to another tank during the adjustment of the mixer to the next function.

10 Claims, 4 Drawing Sheets

HOMOGENIZER

Figure 1:
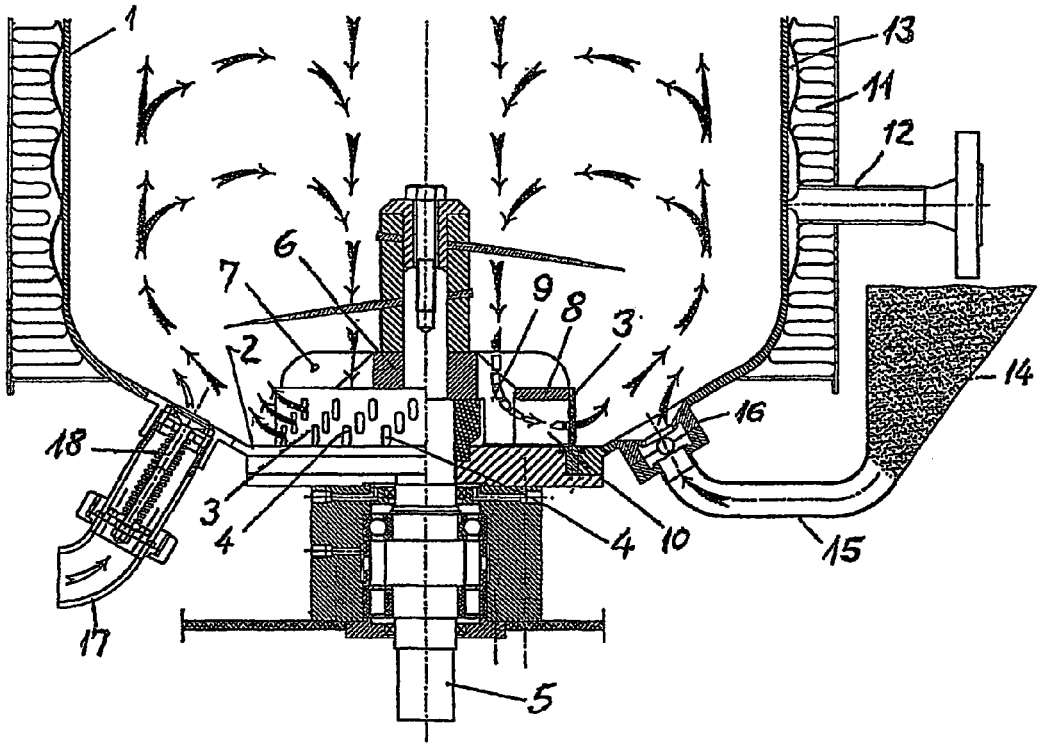

The invention relates to a homogenizer for the processing of products to be homogenized, in particular foodstuffs incorporating dairy produce.

More specifically the invention relates to a homogenizer of the mixer type, hereinafter named a homogenizing mixer, consisting of a closed tank with a bottom and a preferably replaceable circular apertured or perforated mixer ring located at the bottom of the tank, the perforations of said ring being flow orifices shaped as holes and/or slots, the wall of this ring is located at a distance from the tank wall, and a rotational shaft extending into the tank. The rotational shaft is concentrical with the perforated mixer ring and has a part for fixing of a hub to carry a cover plate with a diameter slightly smaller than the inner diameter of the perforated mixer ring, so that the cover plate edge is located radially within the perforated mixer ring. The cover plate has circumferentially spaced openings and a number of circumferentially spaced and radially outwardly directed by means of the shaft rotatable paddle blades secured to its lower side, said paddle vanes being provided with a clearance to the perforated mixer ring wall and to the tank bottom.

Centrifuges are known which are equipped as homogenizing mixers in which a medium to be processed, hereinafter named a processing medium, in this case a fluid, is entered into the tank of the centrifuge and is thrown out from the rotating sieve of the centrifuge with great speed through small holes or narrow slots in the sieve, whereby e.g. globules of fat in milk is crushed to smaller fat globules. Then the fluid—in case of a foodstuff—should normally be further processed in another apparatus. In case of milk the milk should e.g. be pasteurized before being filled into a packing. Only one function can be carried out at a time, and of the centrifuge should be emptied in order to arrange a different sieve size instead of a first erroneously chosen sieve.

Danish Patent No. 128,597 discloses a homogenizing mixer of the known art where a rotatable part carrying paddle blades is axially displaceable relative to a stationary part carrying the mixer ring. A drawback by this device is the rather high speed necessary, 1570–2100 rad per second, which might be reduced to perhaps 280 rad per second by using a centrifugal pump arrangement and e further mixer ring in the rotor part close to the perforated ring in the stator part. Another drawback is that each time the perforation size in a mixer ring should need to be increased, the device should be stopped, emptied, the mixer ring should be replaced, the device should be cleaned, refilled and restarted.

It is the purpose of the invention to provide a homogenizing mixer which is more simple to use than the known apparatus and which may serve more functions in the processing of foodstuffs than the known apparatus for homogenizing of foodstuffs, e.g. so that the foodstuff products aside from a separate or combined homogenization can be mixed, pasteurized, emulsified, dispersed, deodorized, vented etc. as required in one and the same tank, and in embodiments for the homogenizing mixer without any need to transfer the foodstuff product to another tank during the rearrangement of the homogenizing mixer into its next function. Furthermore, the switch from the one function of the homogenizing mixer to its next function or adjustment of one of the functions may often take place without interrupting the rotation of the homogenizing mixer rotor.

This is achieved by a homogenizing mixer of the above mentioned kind which according to the invention is characterized in that the perforated mixer ring is located axially displaceable also during the rotation of the paddle blades for displacement from a position in which a first mixer ring section with a first set of flow or sieve orifices is located radially opposite to the paddle blades, to at least one other position in which another mixer ring section with another set of flow orifices shaped as holes and/or slots or at most a part of a mixer ring section is located radially opposite to the paddle blades.

Thus, it is achieved 1) that the set of flow orifices in the mixer ring, at present positioned opposite to the paddle blades, e.g. if the holes are too small and provides a homogenization too extensive, could be replaced by another set and bigger holes or by no obstruction at all against discharge from the paddle blades without the mixer having to be emptied, 2) that the paddle blades puts a food-stuff product, e.g. in the form of a liquid/liquid or powder/liquid with possible other additives and which should be homogenized, into rotation in the chamber enclosed by the mixer ring, and 3) that the centrifugal force thus obtained throws the product through the chamber and out through the mixer ring orifices and still recirculates the product through the openings of the cover plate. Thus, a foodstuff product is mixed and processed efficiently in a few minutes, also mixtures with a rather high dry solids content and in small or big charges. As previously mentioned a foodstuff product may have one of the following functional conditions in which the product is mixed, pasteurized, homogenized, dispersed, emulsified, deodorized either separately or in combination as required in the same tank.

Figure 2:
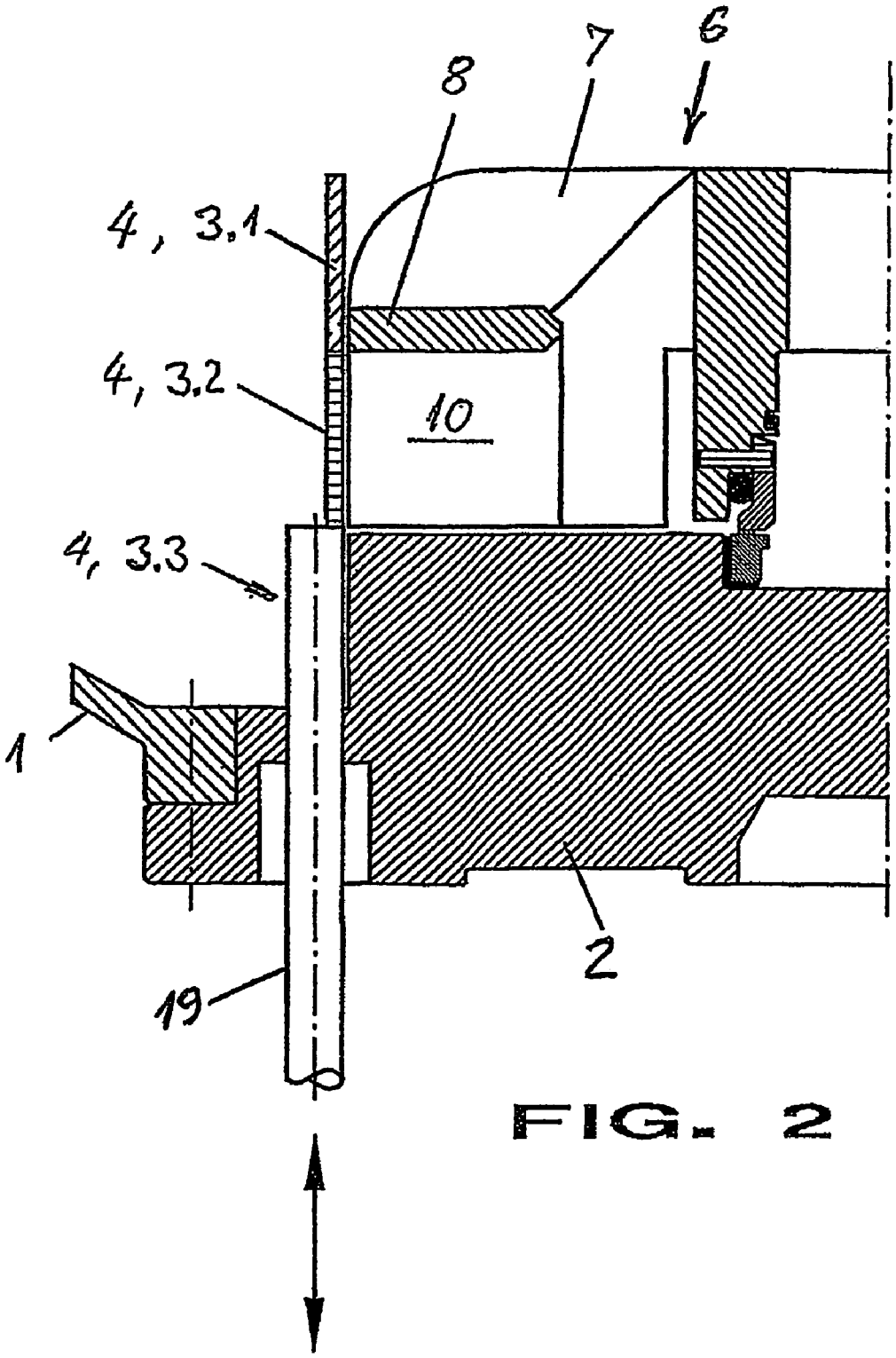
Figure 3:
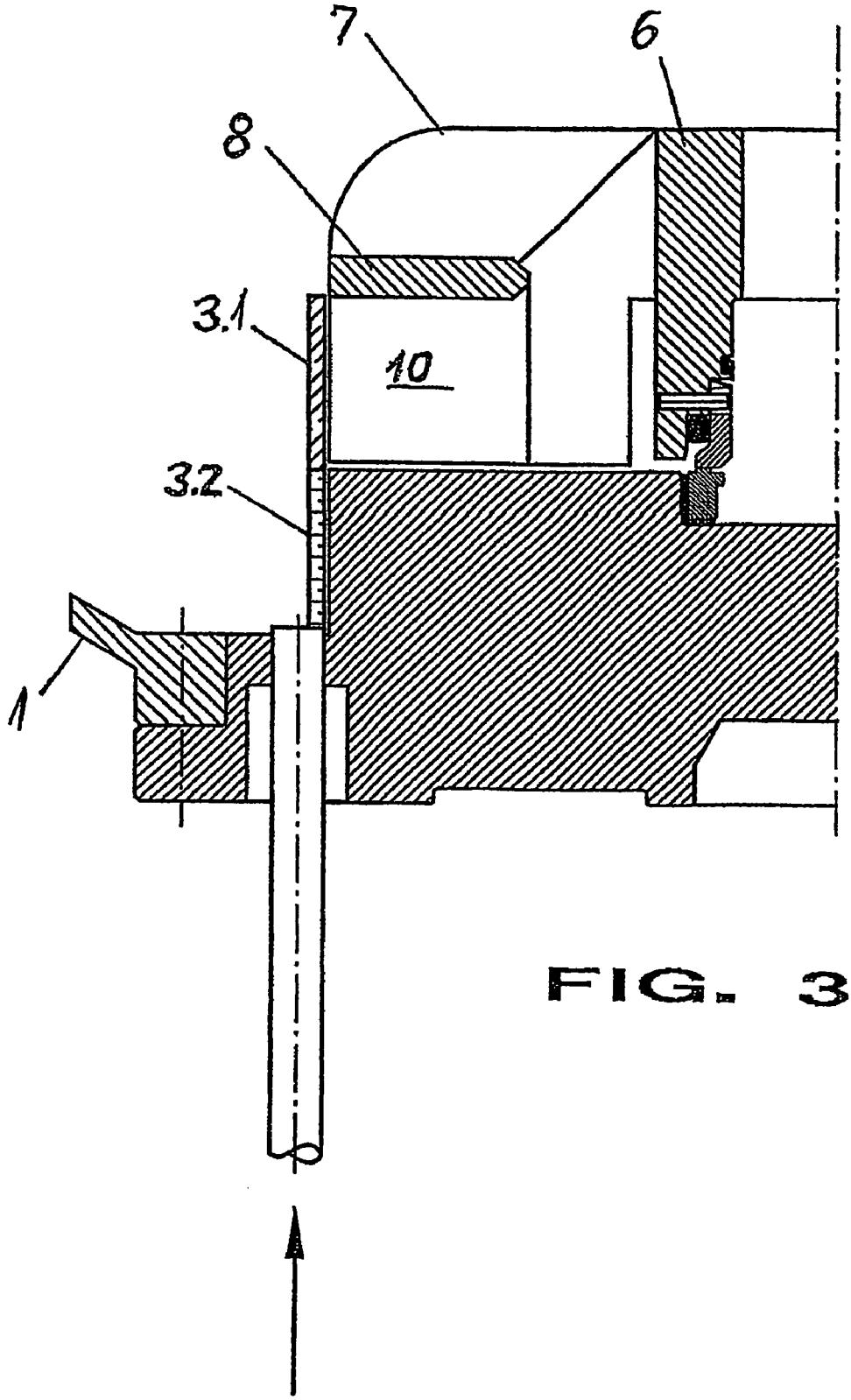
Figure 4:
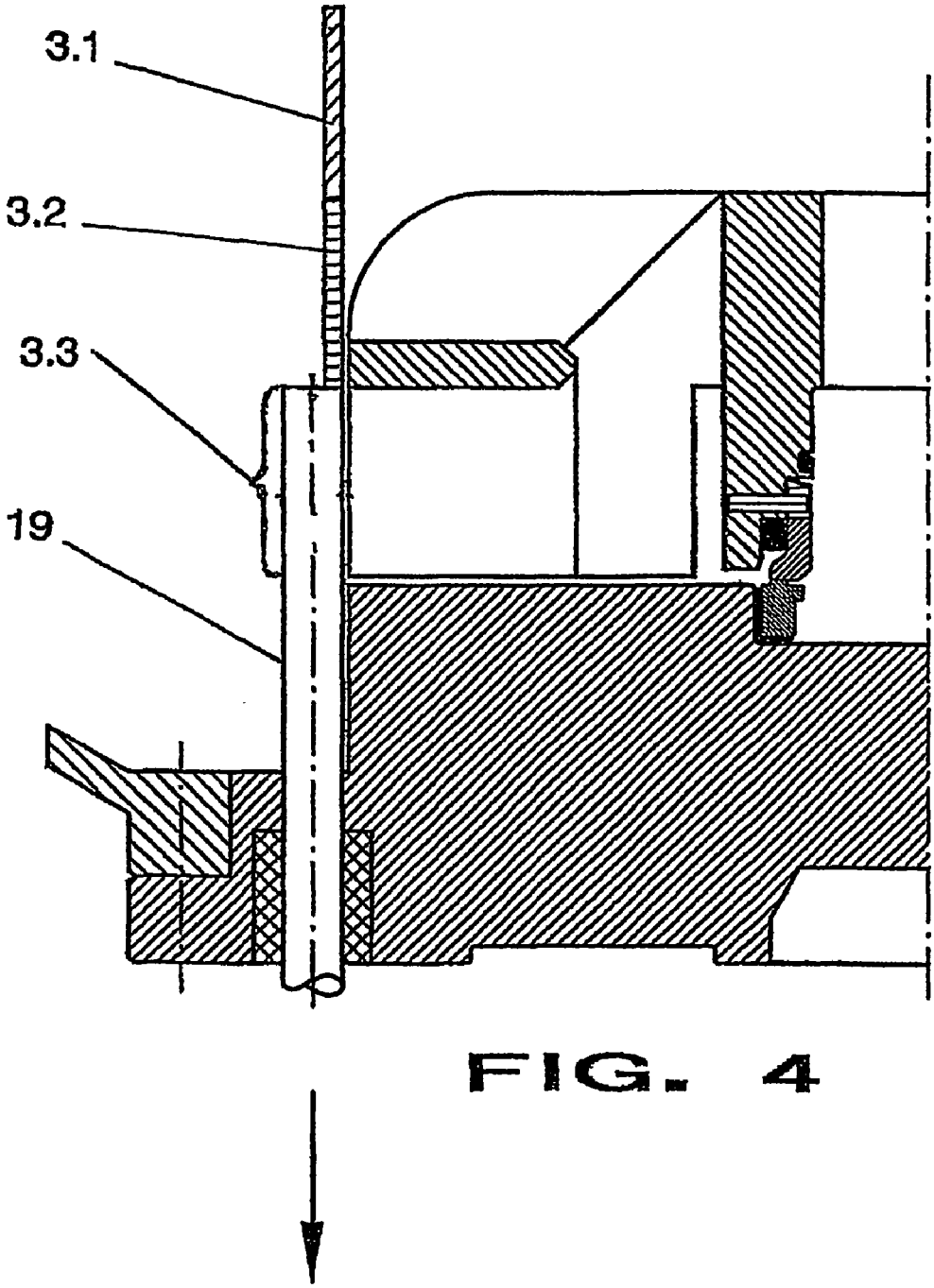

A homogenizer, more specifically a homogenizing mixer according to the invention, will be further explained in the following with reference to the drawing in which:

FIG. 1 shows an axial section in the lower part of the homogenizing mixer and a perforated mixer ring with only one perforated mixer ring section seen from the side, FIG. 2 shows a detail in axial section through the tank bottom and rotor of the mixer, the paddle blade wheel outlet of which may discharge into a intermediate position of an axially displaceable perforated mixer ring with more, here three, mixer ring sections, FIG. 3 shows the items of FIG. 2 in a lower position, and FIG. 4 the items of FIG. 2 in an upper position.

FIG. 1 shows the different elements of the homogenizing, mixer, as well as their function.

It is obvious that the part of the tank 1 bottom 2 supporting the mixer ring 3 may have an inweldable bottom flange for the tank 1.

The tank 1 may be connected to a supply line 15 having a slide valve 16 and a supply hopper 14 for dry matter, e.g. milk powder which can be supplied to the tank 1 when it is evacuated, a supply line 17 with a spring loaded check valve 18 for steam supply, and a supply line 12 for either a cooling agent or a heating agent being provided into a space 13 between the isolation jacket 11 surrounding the tank 1, and the outer wall of the tank.

The mixer ring 3 is here, shaped as a sieve with oblong or circular orifices 4 with a width and a diameter, respectively, not exceeding 3 mm.

The rotational shaft 5 extends through the bottom 2 of the tank 1 and up above the upper edge of the mixer ring 3, where a rotor via its hub 6 is fastened to the shaft, said hub supporting an inducer, here designated as a turbo wheel with turbo blades 7, a cover plate 8 fastened to the lower edges of the blades 7 and with opening 9 arranged below the turbo blades 7 down to the space within the mixer ring 3.

Uniformly spaced in the rotational direction and radially extending number of blades 10 are secured to the lower side of the cover plate 8. The blades 10 rotate the media in the mixer ring chamber thereby creating a powerful centrifugal force forcing the medium to flow through the openings 4 of the mixer ring 3.

The arrows shown illustrate the flows of the processing medium taking place during homogenizing and mixing operation. Fluid and possible additives in the tank are sucked down by the turbo blades 7 from above, through holes 9 in the cover plate 8 and into the chamber within the mixer ring 3, further in between the blades 10 and out through the openings 4 of the mixer plate and upwards into the tank 1 for recirculation.

The detail shown in FIG. 2 illustrates at the double arrow how an axial displacement of a set of parallel liffer rods 19 supporting the perforated mixer ring 3, may position any desired mixer ring section 3.1, 3.2 or 3.3 radially opposite to the discharge level of the paddle blade wheel of the rotor supported by the hub 6, for obtaining a completely or partly unobstructed or free discharge therefrom. Thus it is obtained that function of the homogenizing mixer can be switched to 3.g. full mixing capacity may take place by an axial displacement of the mixer ring 3 without the homogenizing mixer having to stop its paddle blade rotation. If the shown section 3.3 is displaced into a not shown position above the discharge level of the paddle blades, it will be possible wholly or in part to guide the processing medium located at the supplying side of the paddle blade wheel wholly or in part round the blade wheel to its outlet, e.g. for intermediate reduction of the homogenization or for heating the processing medium.

The fact that the perforated mixer ring 3 in its second position in FIGS. 2 and 3 has another section 3.2 or 3.1 with another set of flow holes 4 opposite to the paddle blades 10, and in a third position in FIG. 4 has a third section 3.3 for complete or partly exposing the discharge radially opposite to the paddle blades 10 for a total or partly free discharge therefrom, causes the possibility—by an axial displacement of the mixer ring 3 with its three sections—of an optional shift of function either to a more powerful homogenization, to a weaker homogenization or to a full or partly full mixing function.

The device need not be emptied or stopped during processing. If said third section 3.3 is displaced to a position not shown above the level of the paddle blades 10, it will be possible, as mentioned above, wholly or in part to let the processing medium located at the supplying side of the paddle blade wheel wholly or in part pass by the paddle blades 10 of the paddle blade wheel.

In case the perforated mixer ring 3 is displaceably arranged in its circumferential direction relative to a not shown other mixer ring with smal radial clearance and arranged stationary and coaxially herewith, it will be possible to change the clearance of the flow holes 4 in a simple way, e.g. from a smaller value which might be zero, and to a maximum value which might be the largest orifice size or sieve size of the mixer ring sections.

In case the mixer ring 3 has a diameter of at least 20 cm, preferably 25 cm, and preferably located in the area 20–60 cm, it is achieved that the homogenization could take place by moderate speeds, e.g. by 2500 rpm.

In a preferred embodiment the rotational speed of the rotor or the paddle blade wheel is 2578 r.p.m at the most, an optimization may be obtained of the homogenization without excessive heat development by adapting the diameter of the mixer ring 3 to the lowest desirable speed is possible.

Section 3.3 of the mixer ring 3—which wholly or in part can expose the discharge from the mixer paddle blades 10—is preferably shaped as a not shown wall surrounding, said discharge opening and having a serrated or sinusoidal upper edge, the amplitude of which preferably corresponds to the width of a surrounding belt of flow holes 4 in one of the other sections of the mixer ring 3. Thereby it is achieved—in case the upper edge is located higher than the paddle blade wheel in the mixer—that it is possible in a controlled manner during the homogenizing and/or mixing operation wholly or in part to let the processing medium on the supplying side of the paddle blade wheel wholly or in part pass by the paddle blade wheel or turbo wheel on the hub 6 as mentioned above.

The hub 6 with the rotor preferably supports an inducer located above the cover plate 8, said inducer being shaped as a propeller and/or turbo mechanism, is so arranged that it during the rotation is forcing the liquid through the openings 9 of the cover plate 8 and further into the chamber surrounded by the mixer ring 3 and out through the openings 4 of the mixer ring section 3.1, 3.2, 3.3 located radially opposite to the paddle blades 10. Thereby it is possible by unchanged degree of homogenization further to reduce the rotational speed for the mixer paddle blades 10.

The cover plate 8 is preferably shaped as an inducer in the form of a turbo wheel with turbo blades 7, the edges of which facing the bottom 2 of the tank 1 is fastened to the upper side of the cover plate 8 and along edges in the openings thereof. Thereby a particularly simple embodiment of an inducer is achieved.

The mixer may process dairy products such as e.g. cheese mass, yogurt, ice cream mix, softice, but also foodstuff products such as baby food can be processed. Furthermore, it may process desserts, marmalade, mayonnaise, mustard, soft drinks, etc., creams and ointments for the cosmetic field as well as chemical and pharmaceutical products.

The homogenizer may thus carry out many functions separately or in combination, usually even without any operation stop, and is of a simple construction anyway.

The invention claimed is:

1. A homogenizer for the processing of products to be homogenized, said homogenizer being of a mixer type and comprising:

a closed tank (1) with a side wall and bottom (2) and a replaceable non-rotating, circular, perforated mixer ring (3) located at the bottom of the tank, the perforations of said ring being in the form of flow orifices and/or slots (4), the wall of said ring being located at a distance from the tank (1) wall, a rotational shaft (5) extending into the tank (1), said rotational shaft (5) being concentrical with the perforated mixer ring (3), and being fixed to the hub of a rotor, and carrying an inducer, said inducer including turbo blades (7) and a cover plate (8) carried by the hub, the cover plate having a diameter slightly smaller than the inner diameter of the perforated mixer ring (3), so that the cover plate (8) outer edge is located radially within the perforated mixer ring (3), said cover plate having circumferentially spaced openings (9) and a plurality of circumferentially spaced and radially outwardly directed rotatable paddle blades (10) secured to a lower side thereof, said paddle blades (10) rotating with said shaft and being provided with a clearance to the perforated mixer ring wall (3) and to the bottom (2) of the tank (1), the mixer ring (3) being axially displaceable independent of and during the rotation of the paddle blades (10) to at least one other position, said position being such that a different section of the mixer ring (3.1 or 3.3) is located radially opposite the paddle blades (10).

2. A homogenizer according to claim 1, characterized in that the mixer ring (3) with the mixer ring section (3.3) in its other position (FIG. 4) wholly or in part exposes the circumferentially spaced openings from the paddle blades (10) for wholly or partially free outlet therefrom.

3. A homogenizer according to claim 1, characterized in that the mixer ring (3) in its second position (FIG. 3) has a second section (3.1) with a second set of flow holes (4) opposite the paddle blades (10), and in a third position (FIG. 4) has a third section (3.3) in order to wholly or partially expose the discharge openings radially opposite to the paddle blades (10) for wholly or partially free outlet therefrom.

4. A homogenizer according to claim 1, 2 or 3, characterized in that the mixer ring (3) is displaceably arranged in its circumferential direction relative to another stationary mixer and coaxially arranged ring, there being a small radial clearance between the two mixer rings.

5. A homogenizer according to claim 1, 2, or 3, characterized in that the mixer ring (3) has a diameter of at least 20 cm.

6. A homogenizer according to claim 1, 2, or 3, characterized in that the rotational speed of the rotor is at most 2578 rpm.

7. A homogenizer according to claim 1, 2, or 3, characterized in that the section (3.3, FIG. 4) of the mixer ring (3) which wholly or in part may expose the discharge openings from the paddle blades (10), is provided with a circumferential serrated or sinusoidal edge.

8. A homogenizer according to claim 1, 2, or 3, characterized in that the rotor on the hub (6) supports an inducer arranged above the cover plate (8), said inducer being shaped as a propeller and/or a turbo mechanism provided with turbo blades (7) and arranged so that during the rotation it forces a processing medium through the openings (9) of the cover plate (8) and further into a chamber surrounded by the mixer ring (3) and out through the orifices and/or slots (4) of the mixer ring sections (3.1, 3.2, 3.3) located radially opposite to the paddle blades (10).

9. A homogenizer according to claim 1, 2, or 3, characterized in that the cover plate (8) is shaped as an inducer in the form of a turbo wheel with turbo blades (7), the edges of which facing the bottom (2) of the tank (1) are fastened to an upper side of the cover plate (8) and along edges in the openings (9) thereof.

10. A homogenizer according to claim 7, characterized in that the circumferential serrated or sinusoidal edge has an amplitude which corresponds to a width of a circumferential belt of flow holes (4) in one of the other sections (3.1 and/or 3.2) of the mixer ring (3).

* * * * *